US005412826A

United States Patent [19]

Raubenheimer

[11] Patent Number: 5,412,826

[45] Date of Patent: May 9, 1995

[54] SUCTION CLEANER FOR SUBMERGED SURFACES

[76] Inventor: Dennis A. Raubenheimer, 46 Kloff Road, Bedfordview, Johannesburg, Transvaal, South Africa

[21] Appl. No.: 215,370

[22] Filed: Mar. 21, 1994

[30] Foreign Application Priority Data

Apr. 1, 1993 [ZA] South Africa ..... 93/2356
Jul. 9, 1993 [ZA] South Africa ..... 93/4953

[51] Int. Cl.[6] ..... E04H 3/20
[52] U.S. Cl. ..... 15/1.7
[58] Field of Search ..... 15/1.7

[56] References Cited

U.S. PATENT DOCUMENTS 3,928,202 12/1975 Raubenheimer ..... 210/169
4,521,933 6/1985 Raubenheimer ..... 15/1.7
4,536,908 8/1985 Raubenheimer ..... 15/1.7
4,560,418 12/1985 Raubenheimer ..... 134/18

*Primary Examiner*—Edward L. Roberts, Jr.

*Attorney, Agent, or Firm*—Limbach & Limbach; Michael A. Stallman

[57] ABSTRACT

A turbine driven underwater pool cleaner is disclosed having a housing to which is attached a hose providing a source of suction. The suction functions to draw debris into and through the housing via an opening at the bottom surface of the housing. A rotatable turbine is provided in the flow path of the fluid being drawn through the housing. A pair of wheels are provided which are mounted both for rotation and translation with respect to the housing. A pair of shafts extend from and are driven by the turbine. A radial projection is provided at the end of each shaft. During each revolution of the shaft, the radial projection provides both a rotational and a translation force on the wheel for driving the cleaner in a sure manner about the pool surface. Two alternate approaches are disclosed for steering the cleaner. In one approach, the drive to one of the wheels is selectively disengaged. In another embodiment, the device is steered by placing a torque on the suction hose.

26 Claims, 7 Drawing Sheets

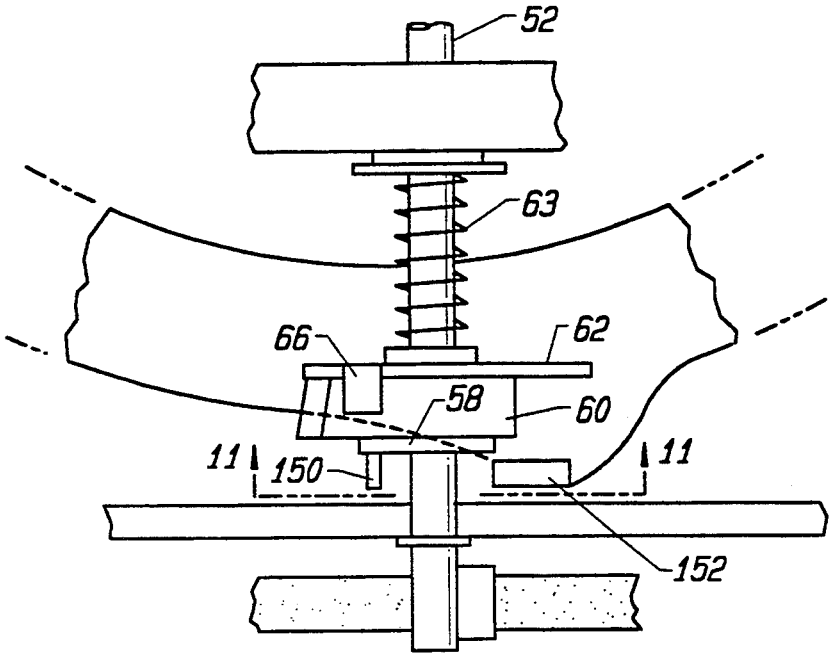
FIG. 10
FIG. 11A
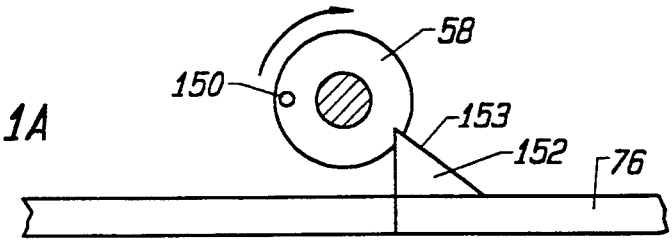
FIG. 11B
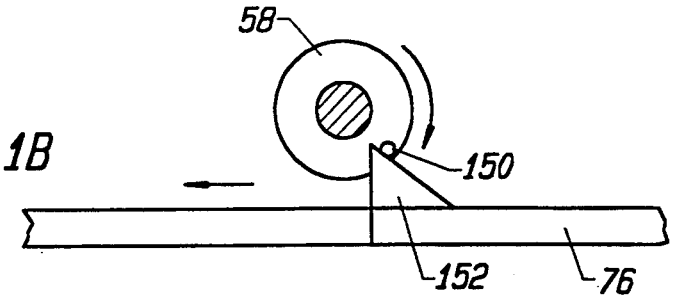
FIG. 11C
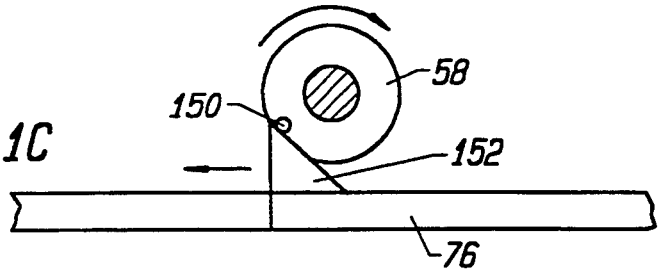

SUCTION CLEANER FOR SUBMERGED SURFACES

TECHNICAL FIELD

This invention relates to a suction cleaner for submerged surfaces.

BACKGROUND TO THE INVENTION

Broadly speaking there are two main types of suction powered cleaners for submerged surfaces, otherwise termed pool cleaners. The first type derives motive power from periodic interruptions, either partial or complete, of the suction flow applied to the cleaner. The second type derives motive power from a turbine caused to rotate by the suction flow.

The turbine type of cleaner has a number of advantages over the interrupted flow type of cleaner. For example, turbine powered cleaners move continuously and smoothly rather than in a jerky fashion. In addition, turbine powered cleaners are much quieter in operation. Another problem with the known interrupted flow types of cleaner is that they have the tendency to miss out certain areas of a swimming pool, with the result that leaves and other debris accumulate in those areas, requiring manual cleaning. In contrast, at least one known type of turbine powered cleaner steers itself in accordance with a set program which provides better coverage over the pool bottom.

The only drawback to existing turbine powered cleaners is that they tend to have relatively complicated drive and steering mechanisms. Therefore, it would be desirable to develop a pool cleaner which retains all the advantages of a turbine powered device yet had less complex drive and steering mechanisms. Descriptions of known turbine driven cleaners can in the following U.S. Pat. Nos. 4,536,908; 4,521,933; and 4,560,418.

SUMMARY OF THE INVENTION

In accordance with the subject invention, a pool cleaner is provided for cleaning submerged surfaces that is powered from the vacuum of a suction hose. The cleaner includes a housing having a suction flow passage to which the suction hose is connected. A rotatable turbine is located within the suction flow. At least one wheel, and preferably two wheels, are mounted to the housing in a manner which allows the wheels to be rotated and translated downwardly against a biasing force. A drive means, powered by the turbine, periodically rotates and translates the wheel. In the preferred embodiment, the drive means includes a shaft, carrying an eccentric formation. The periodic drive increases traction, improving the ability of the cleaner to travel over the submerged pool surface. The periodic drive also acts as a simplified differential allowing the device to be more readily steered.

In one embodiment of the subject invention, steering is achieved by selectively disengaging the drive to one of the wheels. The remaining driven wheel will rotate the cleaner about its axis.

In another embodiment of the subject invention, steering is achieved by placing a torque on the suction hose with the result that the hose applies a reaction force to the cleaner. In this embodiment, the steering means comprises a rotatable ring gear, first ring drive means powered by the turbine for driving the ring gear in one rotary direction, second ring drive means powered by the turbine for driving the ring in the opposite rotary direction, random selection means operating to render the first or second ring drive means operative and the other ring drive means inoperative, the random selection means also determining the period of time for which the selected ring drive means will remain operative, and means operating periodically to transfer the rotational forces from the ring gear to the hose with the result that the hose applies a reaction steering force to the cleaner.

The random selection means in the preferred embodiment comprises at least one lug on the ring gear, a paddle wheel (or secondary turbine) mounted for rotation about an axis transverse to the axis of the ring, paddles projecting outwardly from the paddle wheel and exposed to a flow of water through the suction—flow passage so that the paddle wheel is rotated as a result of such flow of water acting on the paddles, at least one web extending between adjacent paddles, the ring gear and paddle wheel being so arranged in relation to one another that the lug on the ring gear periodically strikes the web with the result that the ring gear applies a driving force to the paddle wheel causing it to move laterally.

The paddle wheel can be supported rotatably relative to a support member carrying a first stop formation which renders the first ring gear drive means inoperative when the ring gear applies a driving force to the paddle wheel in one direction, and a corresponding second stop formation which renders the second ring gear drive means inoperative when the ring gear applies a driving force to the paddle wheel in the opposite direction. The support member itself may be ring-shaped and rotatably mounted in the housing.

The lateral force on the paddle wheel by the lug on the ring gear initiates the rotation of the ring shaped support member. Once this initial rotation has occurred, the repositioning of the first and second stop formations is completed by the interaction between a pin carried on the shaft and a lug formed on the ring shaped support member. This interaction causes the ring shaped support member to complete its rotation moving one of the stop formations into a position to disengage the previously engaged pawl.

In the preferred embodiment, the means operating periodically to transfer rotational forces from the ring gear to the hose comprises an outlet mounted rotatably in the suction flow passage, the outlet including a spigot engagable by the suction hose, a rotary member connected to the outlet, a formation on the rotary member, and an upstanding lug on the ring gear which is capable of striking the formation on the rotary member, thereby to apply a rotational force to that member and hence to the hose.

Each of the first and second ring gear drive means may comprise a cam pawl mounted on a shaft driven by the turbine, the cam pawl in each case being operative to engage the ring gear and index it rotationally. Conveniently there are angularly spaced teeth on the ring gear which are engagable by the respective cam pawls.

Further objects and advantages of the subject invention will become apparent from the following detailed description taken in conjunction with the drawings in which:

BRIEF DESCRIPTION OF THE DRAWINGS

FIG. 10 shows a detail of the rapid changeover mechanism;

FIGS. 11*a*, 11*b* and 11*c* show cross-sections at the line 11—11 in FIG. 10 and illustrate the operation of the rapid changeover mechanism;

DETAILED DESCRIPTION OF THE PREFERRED EMBODIMENTS

Figure 1:
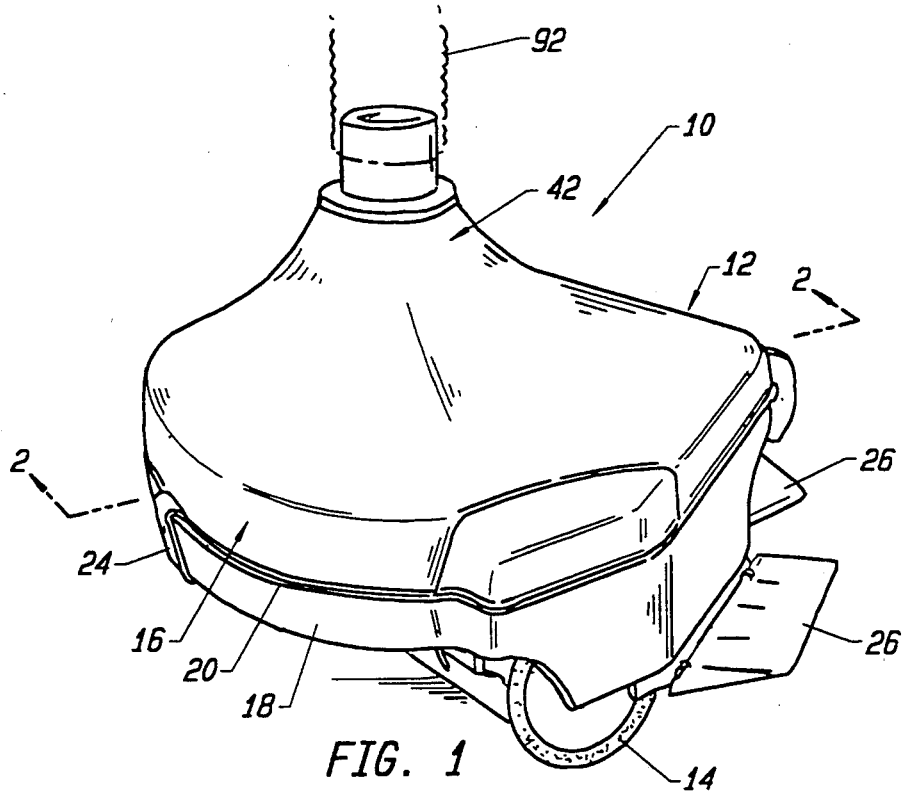
FIG. 1 shows a perspective view of a suction cleaner of the invention.

FIG. 1 shows a suction cleaner 10 designed to clean submerged surfaces. For simplicity, the cleaner 10 may be referred to as a "pool cleaner", one of the most important applications of the invention being to clean the submerged bottom and sides of a swimming pool.

The illustrated pool cleaner 10 has a housing 12 supported on a pair of driven, opposed wheels 14 as described in more detail hereafter. The housing 12 has upper and lower parts 16 and 18 respectively which meet one another at a junction 20 and which are fastened releasably together by means of clips 22 and 24. A resilient gasket is interposed between the parts 16 and 18 to seal them with respect to one another.

A pair of trailing flaps 26 are pivoted to the lower part 18 of the housing 12 on opposite sides of a small wheel 28 which runs on the submerged surface 30 undergoing cleaning. As illustrated, the lower edges of the flaps 26 drag along the surface 30. A further flap 32 is pivoted to the underside of the lower part 18 of the housing 12, more towards the leading end of the housing. The flap 32 is biased towards the pool surface 30 by means of a leaf spring 34.

Located just aft of the flap 32 is an inclined cover defining an entrance 36 leading to a suction opening 38 in the base 39 of the lower part 18 of the housing 12. The opening 38 leads into an internal cavity 40 defined within the housing.

The upper part 16 of the housing 12 tapers towards its upper extremity, indicated generally with the numeral 42. An outlet provided by a spigot 44 extends rotatably through the upper extremity 42 and carries a funnel-shaped member 46. The cavity 40 vents upwardly into the spigot 44 via the bell-shaped member 46. At one point on its periphery, the funnel-shaped member 46 carries a radial projection 48.

Figure 7:
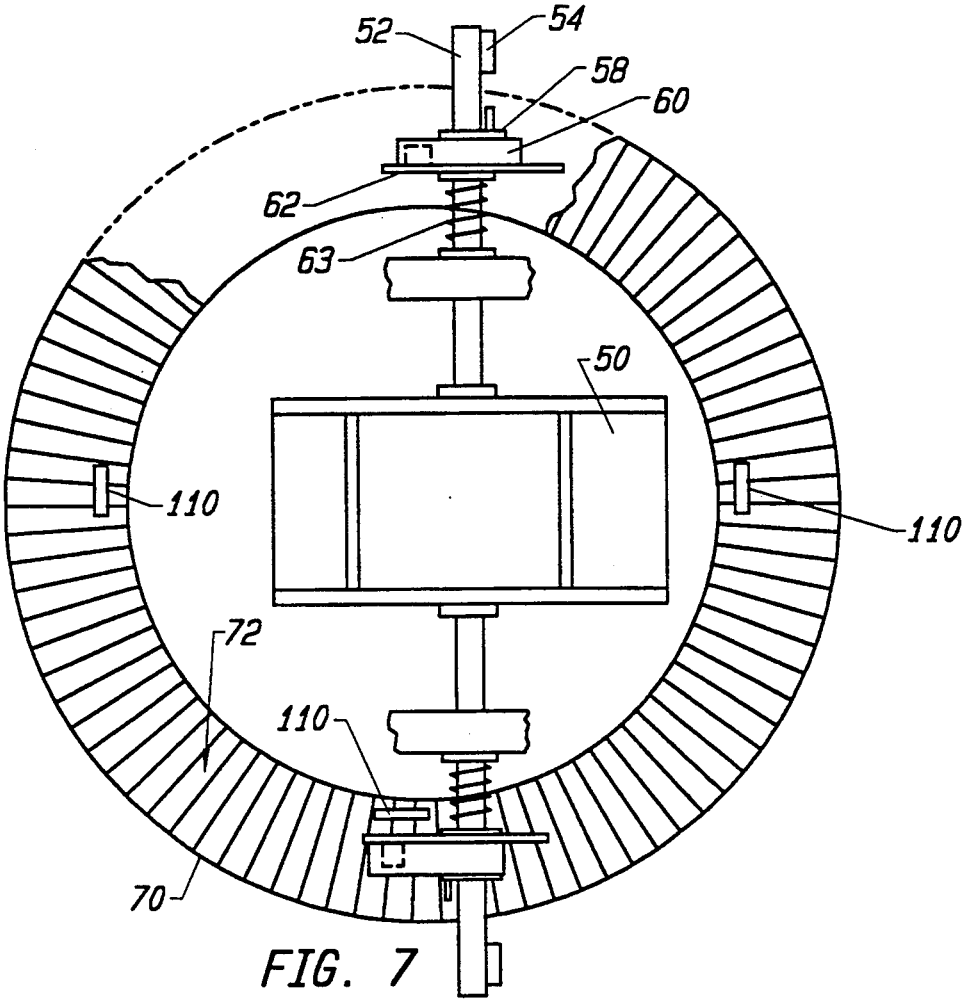
FIG. 7 shows an underplan view illustrating components of the drive and steering mechanisms.
Figure 8:
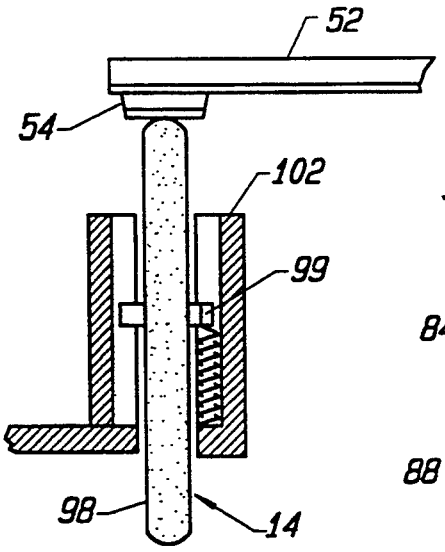
FIG. 8 shows another detail of the wheel drive mechanism.
Figure 12:
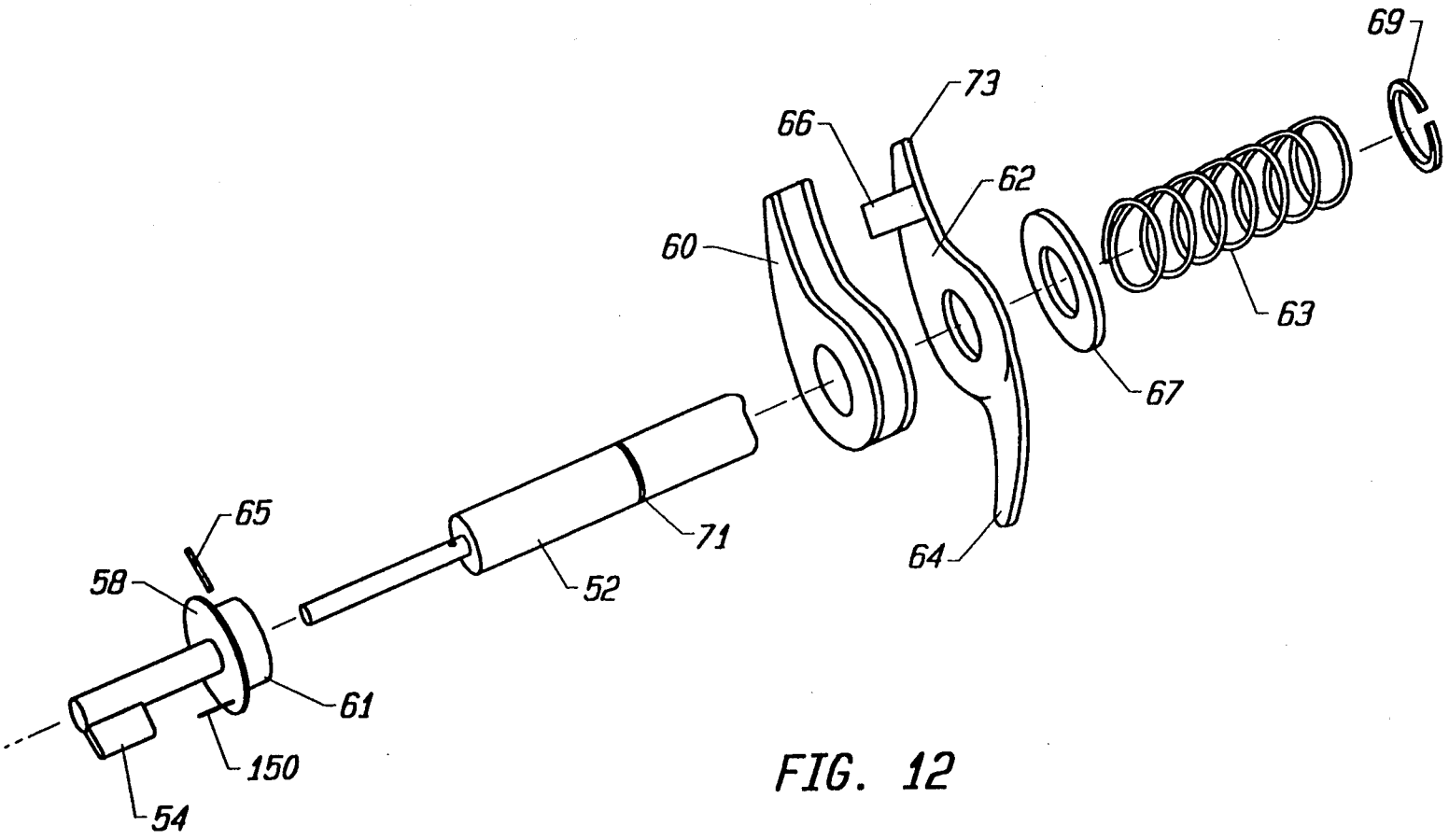
FIG. 12 is an exploded perspective view illustrating the drive elements.

Located within the cavity 40 is a turbine wheel 50 mounted fast on a shaft 52. The shaft is supported rotatably by bearing blocks 53 extending from the base 39 of the lower part 18 of the housing 12. The ends of the shaft 52 extent past the bearing blocks and carry, at their extremities, radially projecting blades 54. Located inwardly of the blade 54 on each projecting end of the shaft 52 is a flange 58 (see FIG. 7) and, located next to the flange 58 in each case is a cam pawl 60 rotatably mounted on an eccentric 61 formed on the shaft. The eccentric 61 is best seen in FIG. 12. As also seen in FIG. 12, the shaft can be formed in two parts, affixed together by pin 65.

Figure 3:
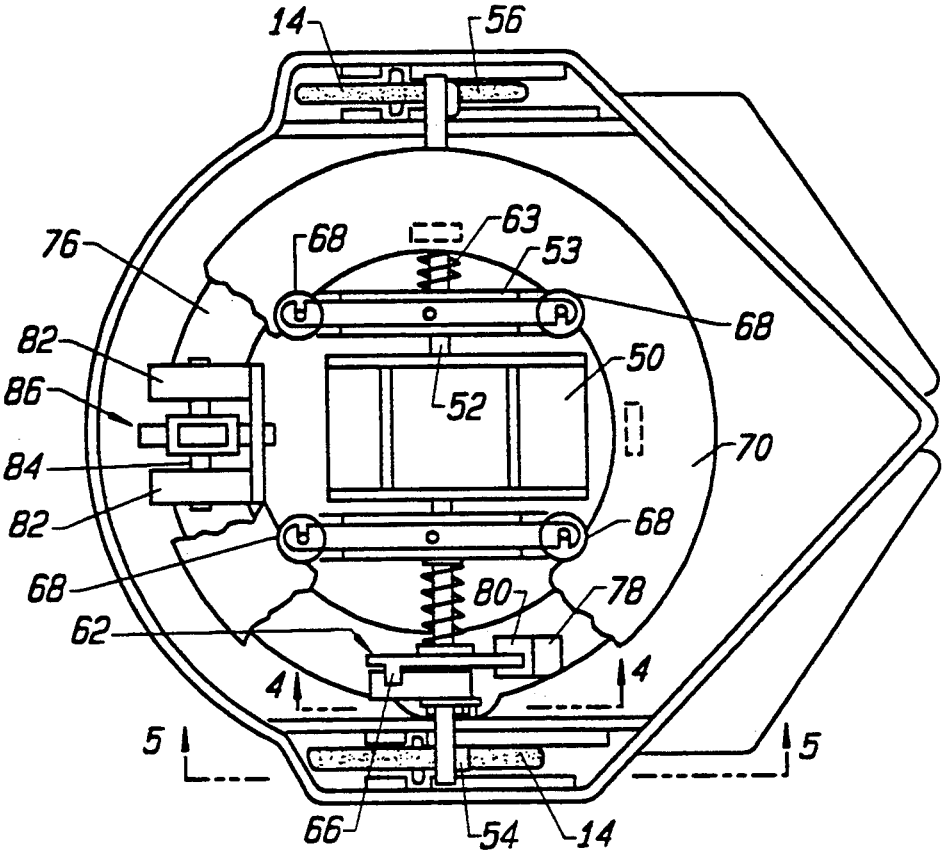
FIG. 3 shows a fragmentary plan view of the internal components of the suction cleaner.
Figure 4A:
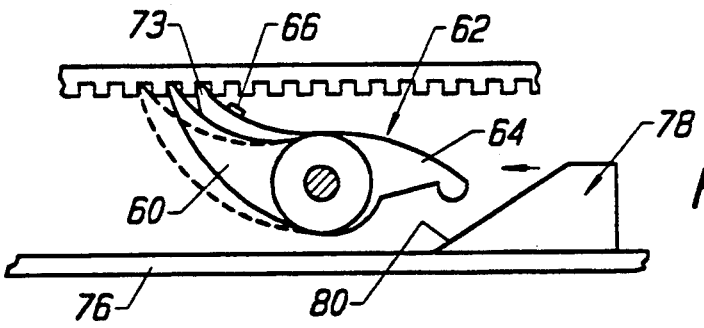
FIGS. 4*a* and 4*b* show cross-sections at the line 4—4 in FIG. 3 and illustrate the operation of the cam pawl mechanisms.
Figure 4B:
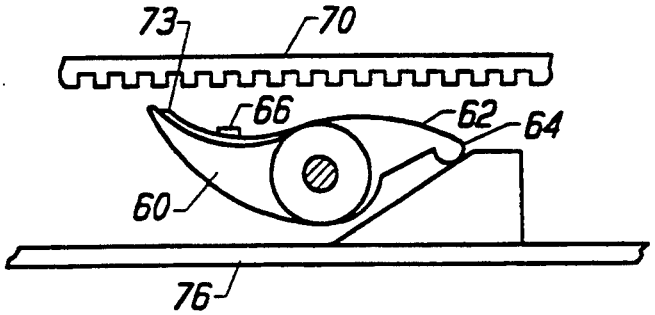

Alongside each cam pawl 60 is a pivoted stop member 62 having a tail portion 64 and a transversely extending stop formation 66 that passes over the upper surface of the pawl as seen in FIGS. 3, 4*a* and 4*b*. The stop member 62 is biased against the associated pawl by means of a compression coil spring 63, but is free to move independently of the pawl on the shaft 52. A clutch washer 67 is provided between the spring 63 and the stop member 62. The assembly is held in place by a circlip 69 which is mounted in a groove 71 formed in the shaft 52. As discussed below, the stop member 62 is biased against the pawl 60 so that the tip 73 of the stop member can act as a ratchet and prevent the ring 70 from turning in the wrong direction.

At its upper end, each bearing block 53 carries a pair of freely rotatable, flanged wheels 68. The four wheels 68 support the radially inner periphery of a ring 70 formed with teeth 72 on its underside. The wheels 68 support the ring 70 in rotatable fashion.

Lower down, each bearing block 53 carries a further pair of freely rotatable, flanged wheels 74 (as seen in FIG. 3). The four wheels 74 support the inner periphery of a support member in the form of a ring 76. The ring 76 carries a pair of upstanding blocks 78 each of which has a sloping surface 80, (see FIGS. 3, 4*a* and 4*b*). The ring 76 is not circumferentially continuous, but includes a gap at one point. 0n opposite sides of this gap, the ring carries upstanding blocks 82 (FIG. 3) which support the ends of a shaft 84 carrying a rotatable wheel or secondary turbine 86.

Figure 9:
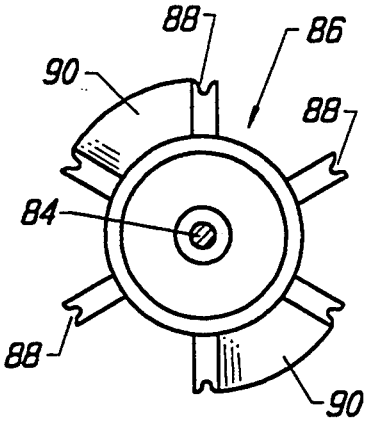
FIG. 9 illustrates the chance wheel.

The wheel 86, which is referred to hereafter as the "chance wheel", has a series of angularly spaced paddle formations 88, the inner tips of which project into the cavity 40. At diametrically opposed positions, webs 90 extend between adjacent paddle formations 88, while the other gaps between the paddle formations remain open, as seen in FIG. 9.

As seen in FIGS. 10 and 11*a*, 11*b* and 11*c*, each flange 5.8 carries an axially projecting pin 150. In addition, the ring 76 is provided a pair of opposed upstanding lugs 152 each having a sloping surface 153. The interaction between the pins 150 and the lugs 152 facilitates the rotation of ring 76 as discussed below.

The operation of the pool cleaner 10 is as follows, it being assumed that the pool cleaner is submerged in a pool with the wheels 14 and 28 on the submerged surface 30 and that a conventional suction hose 92, extending from the pump of the pool filtration unit (not shown), is connected to the spigot 44 as seen in FIG. 1. As explained previously, directional terms such as "up", "down" and so forth are used for the sake of simplicity and refer to a situation in which the pool cleaner 10 is located on a horizontal, submerged surface 30. It should however be recognized that the submerged surface 30 may in fact be a vertical surface, typically the side of a swimming pool, or a surface at an intermediate inclination, such as where the side of a swimming pool merges with the bottom thereof, and directional terms such as "up" and "down" should be understood accordingly.

Figure 2:
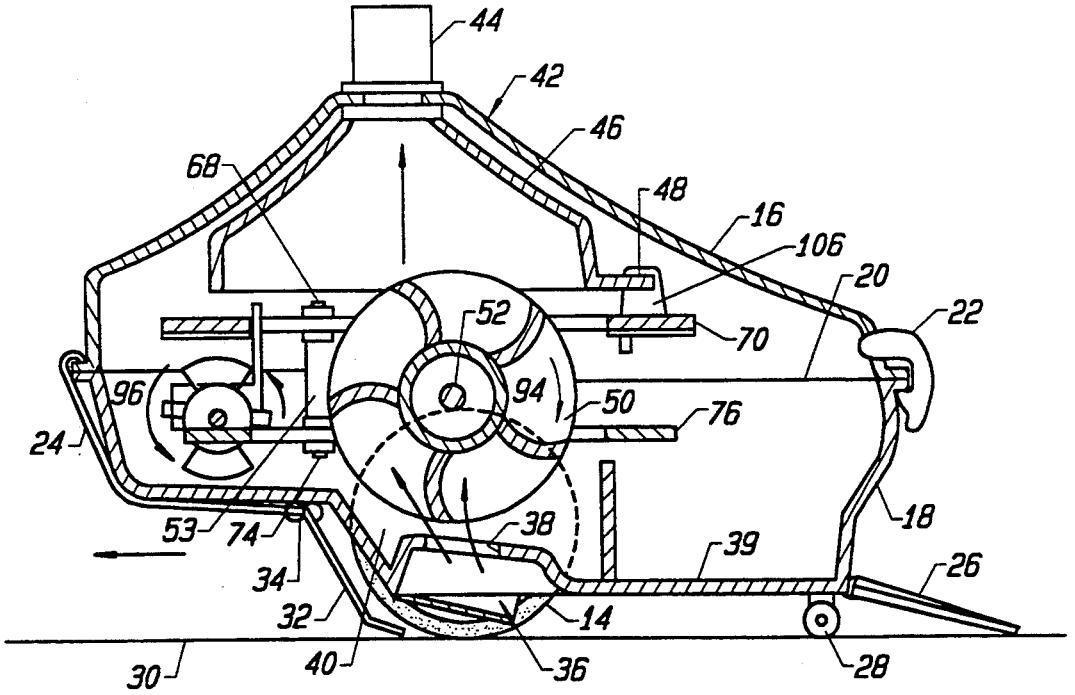
FIG. 2 shows a cross-section through the suction cleaner, taken at the line 2—2 in FIG. 1.
Figure 6A:
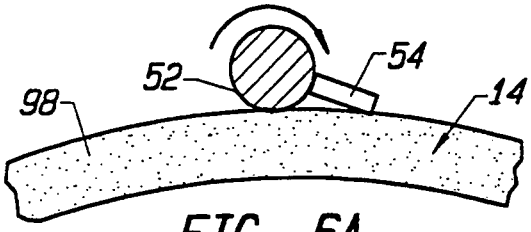
FIGS. 6*a* and 6*b* illustrate the operation of the wheel drive mechanism.
Figure 6B:
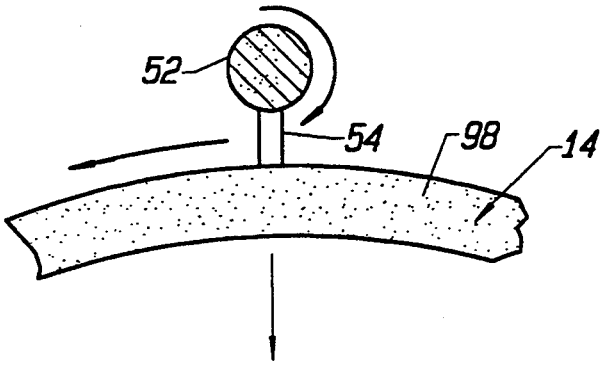

With the pump operational, suction is applied through the hose 92 to the internal cavity 40 of the cleaner. Water and any leaves or particles of muck in the vicinity of the suction opening 38 are accordingly sucked through that opening, through the cavity 40 and through the hose 92 to the pump and filter unit. The water flow through the cavity 40 causes the turbine wheel 50 and shaft 52 to rotate rapidly in the direction of the arrow 94 in FIG. 2. In a typical application, the turbine wheel and shaft may rotate at a speed as high as 400 RPM. At the same time, the water flow impinges on the inner tips of the paddle formations 88 of the chance wheel 86, causing the chance wheel to spin rapidly on the shaft in the direction of the arrow 96. Periodically as the shaft 52 rotates, the blades 54 impact upon resilient rubber treads 98 at the periphery of the wheels 14 as shown in FIGS. 6*a* and 6*b*. In the illustrated case, the blades are synchronized in the sense that they both have the same angular position at all times, and both impact simultaneously on their respective wheel treads. The impact applied by a blade 54 to the tread 98 of the associated wheel 14 has a twofold effect.

Figure 5:
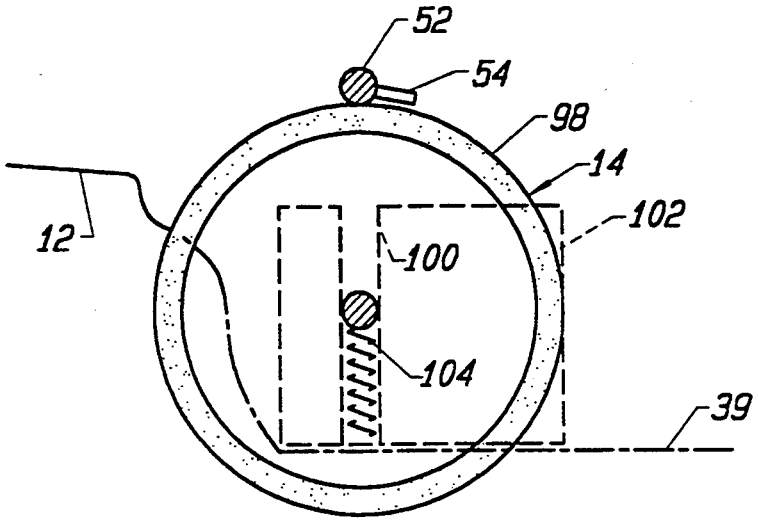
FIG. 5 shows a cross-section at the line 5–5 in FIG. 3 and illustrates the ability of a wheel to translate up and down during driving.

Firstly, the blade applies a downward component of force to the wheel. This is accommodated by the fact that the wheels are supported on stub shafts 99 located in sliding fashion in grooves 100 in bearing blocks 102 at opposite sides of the cleaner 10. The stub shafts 99 are biased upwardly by coil springs 104 (FIG. 5). Thus as a blade applies a downward force to the associated wheel 14, the housing 12 experiences a reaction force which lifts it slightly. As the blade passes over the wheel, the downward force is removed and the springs 104 push the stub shafts 99 upwardly relative to the housing 12 again, thereby restoring the original elevation of the housing above the submerged surface. The downward force drives the wheel into firm frictional engagement with the submerged surface.

Secondly, the blade in each case applies a rotary component of force to the associated wheel as a result of the contact between the blade and the wheel tread. The combined downward and rotary forces drive the wheel in rotation over the submerged surface, with corresponding forward movement of the pool cleaner 10 over that surface, as indicated by the arrow in FIG. 2.

During the period of rotation of the shaft 52 when the blade is not in contact with the wheel, the end of the shaft makes a lighter contact with the wheel. Although some rotational driving force is imparted, the friction is lower during this portion of the revolution which allows the unit to be more readily steered. In this sense, the periodic drive acts as a simplified differential, alternately driving the wheels and reducing friction so that the chosen steering mechanism can be more effective.

During rotation of the shaft 52, one pawl 60 at a time is able to engage and drive the ring 70. In practice, as the shaft 52 rotates, the eccentric cam 61 of each pawl 60 causes the pointed tip of the pawl to reciprocate. During the forward portion of the stroke, the pawl tip will engage a tooth 72 on the underside of the ring 70 and push on that tooth to index the ring through a small angle. The pawl then disengages from the tooth and returns to its starting position. During the next forward portion of the stroke, another tooth is engaged such that ring 70 is indexed through a further small angle. In this manner, the ring 70 is driven stepwise in rotation about its axis. The driving movements of the pawl are depicted in FIG. 4*a*.

For a turbine rotary speed of approximately 400 RPM, the ring 70 will typically rotate about its axis at a speed of 2 RPM.

The ring 70 is prevented from rotating in the reverse direction by the stop member 62, the pointed tip 73 of which also engages a tooth on the ring. The tip 73 remains in engagement with the relevant tooth on the ring after the pawl tip has disengaged itself and while that tip is describing its normal path prior to re-engagement.

The two pawls 60 are arranged to drive the ring in opposite directions and, as stated above, only one pawl at a time is operative. If both pawls were engaged, the ring would jam. Of course, if both pawls become disengaged, there would be no force rotating ring 70 and a steering could not be achieved. The selective engagement of the pawls is due to the fact that, at any given moment, the other pawl is rendered inoperative by the stop member 62, the stop formation 66 of which engages the upper surface of the pawl and prevents the pawl from describing the elliptical path necessary for its pointed tip to engage the teeth 72 of the ring 70. This position of the stop member 62 is a result of the fact that the sloping surface 80 of the associated block 78 on the ring 76 acts against and raises the tail portion 64 of the stop member. This action pivots the stop member 62 about the axis of the shaft 52 to cause the transverse stop formation 66 to bear against the upper surface of the pawl 60 as seen in FIG. 4*b*. More detail about this action is given below.

With one pawl 60 inoperative, the ring 70 is caused to rotate in one direction only. The upper surface of this ring carries an upstanding lug 106 (seen in FIG. 2) aligned circumferentially with the radial projection 48 on the funnel-shaped member 46. Thus it is possible for the lug 106 to contact the radial projection 48 and thereby apply a rotary force to the funnel-shaped member 46 as the ring 70 rotates. The funnel shaped member is non-rotatably attached to the suction hose 92 and the rotary force is accordingly transferred to the hose. The inherent torsional resistance of the hose results in a rotary reaction force on the cleaner 10, which therefore experiences a steering force tending to steer it in the appropriate direction. In essence, the hose steers the pool cleaner.

The steering direction depends on the direction of the rotating force applied to the projection 48 by the lug 106. Random steering of the pool cleaner is achieved by the mechanism described below.

Depending downwardly from the underside of the ring 70 at angularly spaced positions are four equispaced lugs 110 which are at the same radial distance from the axis of the ring 70 as the shaft 84 carrying the chance wheel 86. Rotation of the chance wheel about the axis of the shaft 84 takes place at the same time as the ring 70 is rotating about its own axis. In most cases as the ring 70 rotates, the lugs 110 will be able to go past the chance wheel. This situation will take place when a lug is not obstructed by one of the webs 90, i.e. the lug merely passes through a gap between adjacent paddle formations 88. However, the situation will arise periodically that a lug reaches the chance wheel at the exact moment that a web 90 lies in the rotary path of the lug, with the result that the lug strikes the web. It is not possible to predict whether a web 90 will be present in the path of a lug 110, and a lug/web collision is therefore a random event.

Each time that a collision between a lug 110 and a web 90 takes place, the rotation of the ring 70, caused by that pawl 60 which is, for the time being, the driving pawl, is transferred to the ring 76, which therefore begins to rotate. The direction of rotation of the ring 76 will of course be the same as that of the ring 70 and is dependent on which of the pawls 60 is operative.

The drive imparted to the web causes the ring 76 to rotate through a small angle. Once the ring 76 begins to rotate, the mechanism illustrated in FIGS. 10 and 11*a*, 11*b* and 11*c* function to complete the rotation of ring 76. This additional rotation of ring. 76 functions to bring the sloping surface 80 of the relevant block 78 into contact with the tail portion 64 of the stop member 62 to disengage the pawl.

The mechanism for completing the rotation of ring 76 includes pins 150 projecting axially beyond the respective pawls from flanges 58 carried by the shaft 52, and by upstanding lugs 152 on the ring 76 aligned circumferentially with the pins. The pins are 180° out of phase with one another and each of them describes a circular path about the axis of the shaft 52.

As noted above, a small amount of rotary movement of the ring 76 about its axis, as a result of a collision between a lug 110 and a web 90, brings the lugs 15.2 into the rotary path described by the pins 150. The pin 150 associated with that pawl 60 which is, for the time being, operative, impacts against a sloping surface 153 of the upstanding lug 152 and applies a driving force to it, thereby causing the ring 76 to continue to rotate to bring the sloping surface 80 of the relevant block 78 into contact with the tail portion 64 of the stop member 62 associated with that pawl which is operative at the time. The tail portion 64 rides up the sloping surface 80 and pivots the stop member, in an anticlockwise sense as viewed in FIG. 4, in such a manner that the transverse stop formation 66 bears downwardly on the upper surface of the pawl, thereby preventing that pawl from engaging the ring 70.

At the same time as one block 78 moves into position to disable an operative pawl, the other block 78 moves away from the stop member associated with the inoperative pawl, allowing the latter pawl to become operative again. This pawl then operates in the manner described above to drive the ring 70 in the opposite direction to that in which it was previously driven. At this time, lug 106 will become disengaged with radial projection 48 and the cleaner will travel without any direct steering force. The cleaner will continue to travel without any direct steering force until lug 106 contacts the other side of the radial projection 48. At this point, a rotary force is applied to the funnel-shaped member 46 in a sense opposite to that referred to previously. Thus a torsional force of opposite sense is applied to the suction hose 92. The inherent torsional resistance of the hose transfers a reaction steering force to the pool cleaner 10, which is therefore steered in the opposite direction.

Thus each time there is a collision between a lug 110 and a web 90, there is a reversal of the direction in which the ring 70 rotates. Given the random nature of the chance wheel operation as described above, it may happen that the ring 70 describes a number of complete rotations, with the lug 106 continuously contacting the radial projection 48 before the next collision between a lug 110 and a web 90. In this situation, the pool cleaner will experience continuous steering forces in the same direction before a reversal of steering direction is initiated by a lug/web collision.

Alternatively, it may happen that lug/web collisions occur relatively quickly one after the other, so that the direction of rotation of the ring 70 is reversed quite quickly. If the lug 106 strikes the radial projection 48 at each such reversal, the pool cleaner will rapidly be steered from one direction to another. However, it can also happen that the direction of rotation of the ring 70 changes so quickly that the lug 106 does not strike the radial projection 48, in which case the reversal of ring movement does not result in a change in the direction in which the pool cleaner is steered.

All of these variable features contribute to the random nature with which the pool cleaner is steered. It will be recognized that irrespective of whether or not there is a change of steering direction, the wheels 14 are being driven forwardly so that the pool cleaner is, generally speaking, constantly moving. In some cases, if there is no change of steering direction for some time, the cleaner may traverse a substantial distance in a straight line. On the other hand, if there are frequent changes of direction the cleaner may describe any one of a number of different patterns.

Further variations in the steering patterns can be achieved by modifying the number and/or positioning of the radial projection 48, lug 106 or lugs 110. For example, if it is desirable to minimize the time the cleaner travels in a straight line a pair of closely spaced radial projections 48 could be provided. The selection of these elements can varied based on the type of pool to be cleaned.

A prototype pool cleaner as illustrated and described above has been observed to traverse a swimming pool at substantial speed and to execute random and totally unpredictable changes in steering direction. The random nature of the pool cleaner movement contributes to rapid cleaning of all parts of the submerged surface, and avoids the problem suffered by many modern pool cleaners, namely that of constantly following the same path about the pool and, as a result, leaving large areas of the surface uncleaned.

The prototype cleaner 10 was also observed, by the steering action described above, to extricate itself without difficulty and with little delay from tight comers, swimming pool steps and so forth.

In action, it will readily be appreciated that the flap 32 can pass over small objects such as leaves or the like which may be on the submerged surface, allowing such particles to be sucked into the suction opening 38. On the other hand, the flap may be unable to pivot out of the way of larger objects and hence will prevent such objects from getting sucked into the suction opening and possibly jamming in the cavity 40.

In the first embodiment discussed above, steering is accomplished by placing a torque on the hose. Steering could also be achieved by selectively driving one of two wheels on the cleaner. In this manner, the cleaner can be caused to rotate about the wheel, in much the same manner as a tank is steered through selective driving of the treads.

Figure 13:
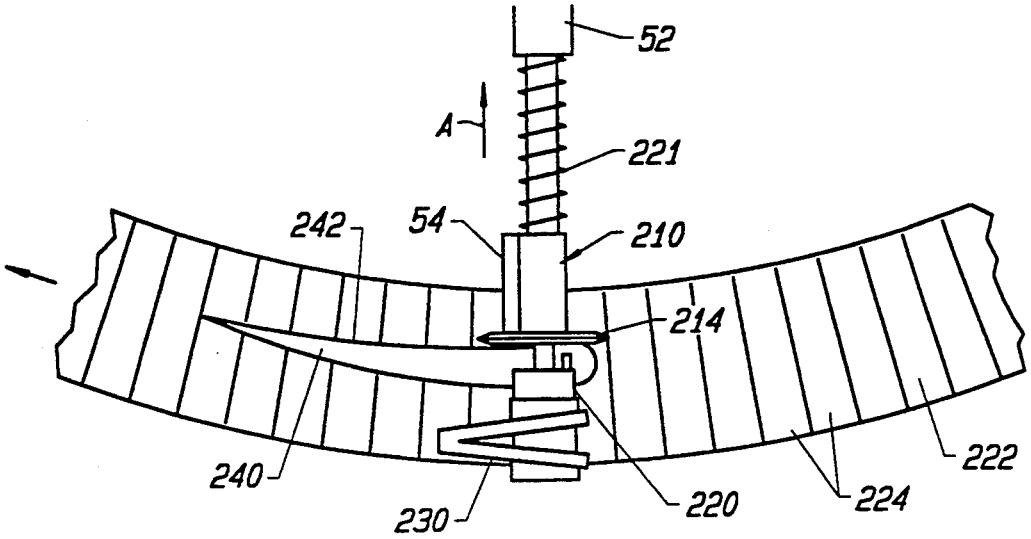
FIG. 13 is an underplan view of the ring gear used in an alternate embodiment of the subject invention where steering is achieved by selectively disengaging the drive to one of the wheels and illustrating the cam mechanism for disengaging the drive to one of the wheels.
Figure 14:
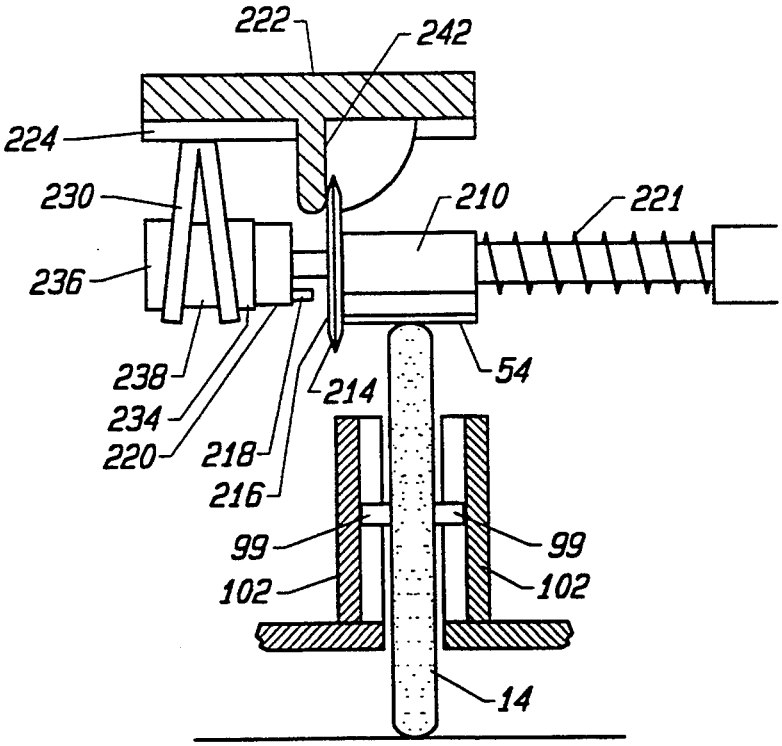
FIG. 14 is a cross sectional view of the alternate embodiment where steering is achieved by selectively disengaging the drive to one of the wheels.

FIGS. 13 and 14 illustrate an alternate embodiment which has been modified to steer by selectively disengaging the drive to one of the two wheels. As in the first embodiment, the cleaner includes a pair of wheels 14 that are mounted to be rotatable as well as translatable against a biasing force. A shaft 52 is driven by the turbine. Mounted on each end of the shaft, adjacent the associated wheel, is a drive member 210 which carries a blade 54. As in the previous embodiment, upon each rotation of the drive member, the blade imparts a rotational and downward force on the wheel causing it to rotate and be driven into high frictional engagement with the pool floor.

In this embodiment, drive member 210 is freely mounted about the shaft 52. The outer end includes an annular disc 214 with a small opening 216 to receive a drive pin 218. Shaft 52 further carries a cap member 220 which carries the axially extending drive pin 218. A spring 221 is provided to bias the drive member 210 against the cap member so that pin member 218 is normally forced into the opening 216. In this position, the cap member is affixed to the drive member and rotation of the shaft 52 is communicated to the drive member.

In accordance with this alternate embodiment, a means is provided for selectively disengaging the drive to one of the wheels. This means includes a structure to selectively separate the cap member from the drive member. To achieve this goal, this alternate embodiment is provided with a ring gear 222 having teeth 224. This ring gear can be mounted in a manner similar to the first embodiment. The ring gear 222 is driven by an pawl 230 eccentrically mounted at the end of the shaft. In this embodiment, pawl 230 is split or has a wishbone configuration to provide a spring-like effect and acts as a clutch. The ends of the wishbone are held in place by retaining flanges 234 and 236. An eccentric 238 is provided to cause the end of the pawl to follow a path similar to that described above with respect to the pawl in the first embodiment.

In this embodiment, ring gear 222 only needs to be driven in one direction. Therefore, only one pawl 230 is necessary and the more complex pawl disengagement structure used in the first embodiment is unnecessary. In addition, the teeth 224 of the ring gear can be formed with an angled configuration rather than the square configuration of the first embodiment. As can be appreciated, as the shaft is rotated by the turbine, the pawl will function to rotate the ring gear in stepwise fashion. A separate resilient spring blade (not shown) can be mounted to engage the teeth of the ring gear to prevent the ring gear from turning in the opposite direction. Alternatively, a ratchet action of the type provided by the tip 73 of stop member 62 in the first embodiment could be used.

In accordance with this alternate embodiment, the under surface of the ring gear is provided with a cam formation 240. As the ring gear rotates, the cam formation 240 moves alongside each drive member 210 in turn. When the formation 240 reaches a drive member, the disc 214 of the drive member rides onto the cam surface 242 of the formation. The cam surface 242 urges the disc to move in the direction shown by arrow A in FIG. 13 such that the pin 218 becomes disengaged with the drive member 210 as shown in FIG. 13.

Once disengagement has taken place, the drive member 210 is effectively disengaged from the shaft 52. As long as the drive member remains disengaged from the shaft 52, there is no drive to the wheel 14. Thus, drive is only applied to the other wheel and this causes the whole pool cleaner to undertake a sharp change in direction.

When the cam surface 242 has passed completely by the disc 214, the drive member 210 is returned to the engagement position by the spring 224, and drive is once again applied to the wheel in question.

Thereafter, when the cam formation 240 reaches the disc 214 on the other side of the shaft 52, drive to the other wheel is terminated and the pool cleaner will undergo another sharp change in direction, in this case in the opposite sense.

The frequency of the direction changes is a function of the time lapse between the cam formation 240 moving from one drive member 210 to the other. This time lapse can be reduced by providing more than one cam formation or by varying the number of teeth on the ring gear 222. The actual angular magnitude of each direction change is determined by the length of the time during which there is no drive to a particular wheel and this is in turn dependent on the circumferential length of the cam formation 240.

I claim:

1. An underwater pool cleaner comprising:

a housing;

means located within said housing for cleaning the surface of a swimming pool;

wheel means;

means for upwardly biasing said wheel means;

means for rotatably mounting said wheel means to said housing, said mounting means further allowing said wheel means to be translated downwardly against the biasing means; and drive means affixed to said housing and coupled to said wheel means, said drive means intermittently imparting a force to said wheel means in a manner to cause said wheel means to rotate and be translated downwardly against said biasing means.

2. A cleaner as recited in claim 1 wherein said drive means includes a rotatable drive shaft, with said drive shaft being frictionally engaged with said wheel means, said drive shaft including a radial projection for intermittently imparting a force to said wheel means in a manner to cause said wheel means to rotate and be translated against said biasing means.

3. A cleaner as recited in claim 2 wherein said means for mounting the wheel means includes a wheel shaft, said wheel shaft being journaled in an elongated channel formed in said housing, and wherein said biasing means includes a spring mounted in said channel and providing a biasing force against said wheel shaft.

4. A cleaner as recited in claim 3 wherein said wheel means includes a pair of opposed wheels.

5. A cleaner as recited in claim 4 further including separate drive means for each wheel.

6. A cleaner as recited in claim 5 further including a means for selectively disengaging one of the drive means from the associated wheel to steer the cleaner.

7. A cleaner as recited in claim 6 further comprising:

a rotatably mounted ring gear;

means for rotating the ring gear; and wherein the means for selectively disengaging one of the drive means from the associated wheel to steer the cleaner includes a cam means formed on said ring gear which is selectively engagable with the drive means to decouple the drive means from the associated wheel.

8. A cleaner as recited in claim 2 wherein said drive means further includes a rotatably mounted turbine, said turbine being driven by fluid flow through the housing created by a source of suction, and wherein said drive shaft is driven by said turbine.

9. A cleaner as recited in claim 8 wherein said source of suction is supplied to said cleaner via a flexible hose non-rotatably attached to said housing and wherein said cleaner includes a steering means for generating a rotational torque on said hose.

10. An underwater suction pool cleaner for cleaning a pool surface comprising:

a housing having an opening on the bottom thereof, said housing being connectable to a source of suction for vacuuming debris through said opening;

a pair of wheels;

means for upwardly biasing said wheels;

means for rotatably mounting said wheels to said housing, said mounting means further allowing said wheels to be translated downwardly toward the bottom of said housing against the biasing means;

steering means coupled to said housing;

a turbine rotatably mounted in said housing and being driven by fluid flow through the housing created by said source of suction; and drive means coupled between said turbine and said wheels, said drive means intermittently imparting a force to said wheels in a manner to cause said wheels to rotate and be translated downwardly against said biasing means thereby intermittently increasing the traction between the wheels and the pool surface and alternately reducing traction thereby facilitating steering.

11. A cleaner as recited in claim 10 wherein said drive means includes a pair of rotatable drive shafts powered by said turbine, with said drive shafts being frictionally engaged with said wheels, each said drive shaft including a radial projection for intermittently imparting a force to the associated wheel in a manner to cause said wheels to rotate and be translated against said biasing means.

12. A cleaner as recited in claim 11 wherein the means for mounting each said wheel includes a wheel shaft, said wheel shaft being journaled in an elongated channel formed in said housing, and wherein said biasing means includes a spring mounted in said channel and providing a biasing force against said wheel shaft.

13. A cleaner as recited in claim 10 further including a means for selectively disengaging the drive means from one of the wheels to steer the cleaner.

14. A cleaner as recited in claim 13 wherein said steering means includes:

a rotatably mounted ring gear;

means for rotating the ring gear; and wherein the means for selectively disengaging the drive means from one of the wheels to steer the cleaner includes a cam means formed on said ring gear which is selectively engagable with the drive means to decouple the drive means from the associated wheel.

15. A cleaner as recited in claim 10 wherein said source of suction is supplied to said cleaner via a flexible hose non-rotatably attached to said housing and wherein said steering means includes a means for generating a rotational torque on said hose.

16. An underwater pool cleaner connectable to a flexible hose providing a source of suction, said cleaner comprising:

a housing;

means for moving the cleaner in a forward direction;

a support member rotatably mounted to said housing and including a spigot non-rotatably connectable to said suction hose, said suction hose creating a flow of fluid into and through said housing;

a turbine mounted to be rotatably driven by said flow of fluid;

a rotatably mounted ring gear;

means for selectively coupling the ring gear to the support member; and drive means powered by said turbine for selectively rotating said ring gear in either a clockwise or counterclockwise direction, said ring gear rotatably driving the support member and generating torque on said hose to steer the cleaner.

17. A cleaner as recited in claim 16 wherein when the direction of rotation of the ring gear is reversed, the coupling means will become disengaged for a period of time allowing the cleaner to move without a steering force.

18. A cleaner as recited in claim 17 further including a drive shaft mounted on said turbine and with said first and second pawls being eccentrically mounted to the opposed ends of the drive shaft.

19. A cleaner as recited in claim 17 further including a control means for selectively disengaging one of the pawls from the ring gear.

20. A cleaner as recited in claim 19 wherein said control means includes a control ring rotatably mounted to said housing, said control ring including a pair of opposed cam means for selectively biasing one of the pawls into disengagement with the ring gear.

21. A cleaner as recited in claim 20 further including a means for selectively rotating the control ring to selectively position one of the opposed cam means adjacent the associated pawl to disengage the pawl.

22. A cleaner as recited in claim 21 wherein means for rotating the control ring includes a member projecting from said ring gear and wherein said control ring further includes a secondary turbine driven by said fluid flow, said secondary turbine being configured to periodically engage with the member of the ring gear causing said control ring to be partially rotated.

23. A cleaner as recited in claim 22 wherein said means for rotating the control ring further includes a pair of opposed angled projections on said control ring and further including a pair of shafts rotatably driven by said turbine, with the ends of each shaft carrying an axial projection which engages with one of the angled projections on the control ring after it has been partially rotated, said engagement functioning to complete the rotation of the control ring disengaging associated pawl.

24. A cleaner as recited in claim 20 further including a stop member associated with each pawl, said stop members including a stop formation engageable with the ring gear and acting as a ratchet, said stop member further including a tail portion which engages with the cam means on the control ring to disengage the pawl.

25. A cleaner as recited in claim 16 wherein said drive means includes first and second pawls alternately driving the ring gear, wherein said first pawl drives the ring gear in a clockwise direction and the second pawl drives the ring gear in a counterclockwise direction.

26. A cleaner as recited in claim 16 wherein said means for moving the cleaner in a forward direction is driven by the turbine.

* * * * *